United States Patent [19]

Schmid

[11] 3,975,848

[45] Aug. 24, 1976

[54] CALENDAR

[76] Inventor: Hans R. Schmid, Kiessstrasse 23, Stuttgart-Sonnenberg, Germany

[22] Filed: May 17, 1974

[21] Appl. No.: 470,993

Related U.S. Application Data

[63] Continuation of Ser. No. 335,746, Feb. 26, 1973, abandoned.

[30] Foreign Application Priority Data

Mar. 8, 1972 Germany ..... 2211066

[52] U.S. Cl. ..... 40/110

[51] Int. Cl.[2] ..... G09D 3/00

[58] Field of Search ..... 40/107, 142 A, 119, 40/110

[56] References Cited

FOREIGN PATENTS OR APPLICATIONS

| | | | |
|---|---|---|---|
| 301,475 | 11/1954 | Switzerland | 40/119 |
| 247,119 | 2/1926 | United Kingdom | 40/142 A |
| 255,699 | 7/1926 | United Kingdom | 40/107 |

*Primary Examiner*—Louis G. Mancene
*Assistant Examiner*—John H. Wolff

[57] ABSTRACT

A calendar comprising a plurality of pages, a conforming ferromagnetic plate and ring fastening means located along one edge of the pages and the plate binding said pages and plate. The pages are flipped from one side of the plate to the other, and a magnetic indicator adapted to overlie the pages and be forced against the plate is provided. The pages are imprinted on one side with chronological indicia and arranged with respect to the plate so that they lie face up on one side of the plate and face down on the other side and with respect to each other in reverse order so that initially all of the printed pages lie face down and must be turned up sequentially to the latest page in chronological order.

3 Claims, 2 Drawing Figures

CALENDAR

This is a continuation of application Ser. No. 335,746 filed Feb. 26, 1973, now abandoned.

BACKGROUND OF THE INVENTION

The present invention relates to the construction of a calendar.

Calendars are known which comprise a plurality of pages bound together with a ferromagnetic plate having a cooperating magnetic marker which is placed over the given date to both indicate the same and hold the page. The pages are mounted so that their printed faces initially fall behind the ferromagnetic plate and flip over their edge to present the latest page in chronological order. The known calendars are in themselves satisfactory but they do have a number of disadvantages. They are generally difficult to manufacture and as a result they are relatively more costly than the more conventional form of calendar.

It is the object of the present invention to provide an improved calendar, one which is cheaper and easier to make and one which may be easily used and handled.

Further objects will be seen from the following disclosure.

SUMMARY OF THE INVENTION

The objects of the present invention are simply attained by assembling the pages of the calendar, and the ferromagnetic or metallic plate with a ring, spiral or similar wire binding means and by providing the metallic plate sufficiently thin so that it may be perforated with a series of holes, in virtually the same manner as the calendar pages are worked, to receive the binding means. The structure and assembly of the metallic plate is hardly distinguishable from that of the other calendar elements.

The calendar pages are provided with printing, indicating the chronological periods, on only one side and are arranged with respect to the metallic plate so that the printed face lies upward on one side of the plate and downward toward the plate on its other side. In this manner the chronology of the pages can be selected so that sequentially only the earliest pages are face up and after their use may be torn from the binding.

Preferably the metallic plate is made of thin sheet metal, for example, about 0.1 mm thick, so that its perforation to create the binding holes, or its working for any other purpose would not present any unnecessary difficulty, and normal paper or board working equipment may be used. To prevent the plate from rusting and to provide a most decorative appearance it is preferred that at least one side of the plate be coated or covered. The metallic plate may be assembled with the calendar pages so that when it is packaged it lies on top forming a cover for the pages. Thus the coating for the plate can be imprinted with colorful, graphic artistic creation or text.

The plate may also, in another variant, be covered with a layer or sheet of plastic which is laminated to the metal surface. In this instance it is obvious that the thickness of the laminate sheet should not be chosen too great so that it would interfere with the holding power of the indicator magnet. The laminate sheet should be made of material which is easily pressed in place on the plate and which may be easily imprinted with the desired graphic or textual information. Preferably, the laminate sheet is somewhat porous and/or permeable to air so that when laminated onto the metal plate, all air and vapor may be expelled from between them and a firm, lasting secure bond can be made.

In still another embodiment the plate may be made basically from a sheet, board or member of non-ferrous material, such as plastic. Small ferrous particles, iron filings or magnet particles are then embedded in the sheet to provide the necessary magnetic backing.

Full details of the present invention are given in the following description and shown in the accompanying drawings.

DESCRIPTION OF THE INVENTION

Figure 1:
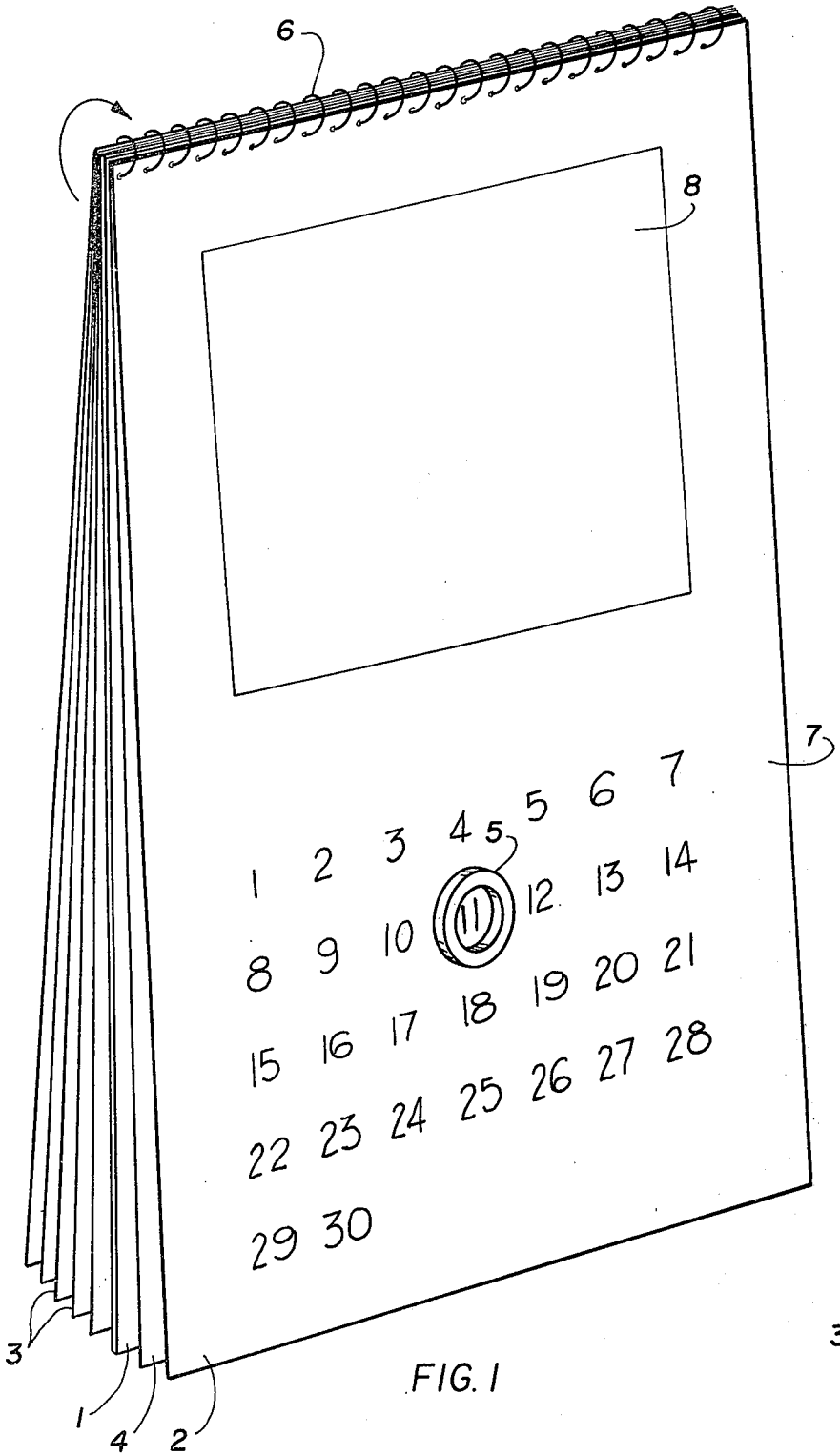
FIG. 1 is a perspective view of a calendar embodying the present invention.

As illustrated in the drawings the calendar of the present invention comprises in combination, a stiff backing wall 1 serving as a support, (although its existence is not absolutely necessary) a plurality of calendar pages each having a front face 2 and a rear face 3, a ferromagnetic plate or sheet 4 and a marking magnet 5. The backing wall 1, the calendar pages 2, 3 and the magnetic plate 4 are joined along their top edge by a ring type binder 6 such as a spiral loose leaf fastener passing through a row of cooperating holes. The assembly of backing wall, pages and magnetic plate may be joined by other suitable means, such as ring fasteners, yarn loops, stitch means, etc., to provide the loose leaf combination and ability of the pages to easily flip and be turned edge over edge. In use the pages, magnetic plate and back wall lie flat against each other and the spread between the pages as seen in the figures of the drawing which are for illustration only, does not exist.

Each of the front faces 2 of the calendar pages are imprinted with a specific calendar portion, such as a month, week, two week period or a more or lesser period as desired. The rear face 3 is left unprinted or provided only with illustrations not connected with the calendar. Preferably only a portion of the calendar page face 2 indicated by the numeral 7 is provided with the calendar indicia, while another portion indicated by the numeral 8 is reserved for the imprinting or provision of an advertisement, illustration, work of art or any combination of these. If desired the illustration for the portion 8 may be separately manufactured and pasted, glued or otherwise secured over the portion 8.

Figure 2:
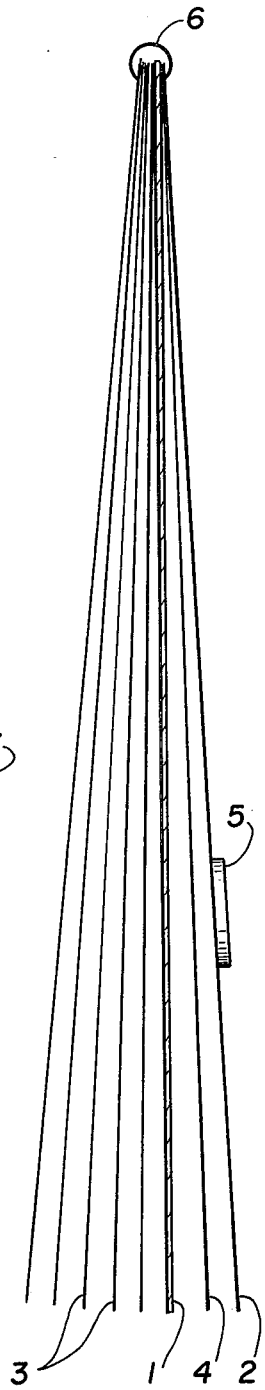
FIG. 2 is a vertical section through the calendar of FIG. 1.

The assembly of the several elements is made in a particular, selected chronological order, so that when in use the faces 2 lie printed side upward in front of and on the magnetic plate 4 while the rear faces 3 lie printed side downward in back of the plate 4. One way of accomplishing this is, as illustrated, to initially fasten all of the pages in the ring binder in reverse order between the magnetic plate 4, serving as the top or cover page, and the backing wall 1 serving only as a protector and support. Thus, for example, using the plate as the reference, the earliest calendar page is set next to it but its printed face would be facing the backing wall, the succeeding calendar pages would lie sequentially on top of one another in reverse order but also facing the backing wall. In use the calendar is then stood on its free edge as indicated in FIG. 2 and to observe the first calendar page it would be necessary to flip the back wall and all the pages but the first to the rear of the magnetic plate. Thus all the printed pages 2 would lie closed toward the plate 4 (and wall 1) and only on flipping the individual pages from the back to the front in sequential order are the front faces visible and in the proper chronology. The pages are thus so organized that all those containing the future or upcoming calendar periods lie directly behind the magnetic plate with the printed side face up. The magnetic plate or the backing wall, while the present calendar period is flipped forwardly to normally lie on top of the magnetic plate with the printed side up. The magnetic indicator 5 is placed over the face up page and moved from day to day to indicate the correct date.

Preferably the pages containing the past calendar periods are torn immediately from the fastener upon passage of their last date so that only one page (i.e. the latest calendar page) rests on the magnetic plate 4. In this manner the force of the magnetic indicator is employed to hold only one page between it and the magnetic sheet 4, and is less likely to be dislodged from its correctly indicated date. As the intervals pass the pages used up are successively torn from the calendar and the pages from in back of the plate 4 or wall 1 are turned over into position.

The ferromagnetic plate 4 is preferably formed of a ferrous metal sheet or thin foil member of about 0.1 mm thickness which may be coated on one or both of its sides. The coating may be a paint, varnish, lacquer, synthetic plastic deposited thereon or a lamentation particularly of a sheet of plastic material glued or otherwise adhered to the metal sheet. Insofar as only one side is coated, the coating may be accomplished through spraying, brushing or rolling the color. If both sides are to be coated the sheet or plate 4 may be dipped or immersed in a bath of the coating material. In any event the coated or uncoated plate may be provided with an imprint of any desired nature. If this is desired, it is to be observed that the laminate sheets should be porous or at least provided from air permeable material so that it will cling smoothly to the plate and will be impressed without any difficulty-or any retention of air or vapor below the surface.

The magnetic plate may on the other hand be formed of a sheet or board of non-ferrous material, such as plastic, in which ferrous material such as iron filings are embedded. Instead of iron filings small magnetic particles or small magnets may be lodged in the plastic board.

The magnetic plate 4 can be made of a stiff sheet or board and serve also as the supporting wall for the calendar, thus eliminating the need for a backing wall 1. The magnetic indicator 5 is preferably a permanent magnet, and may be round, square or of another shape. It too may be coated or painted or otherwise made as decorative as possible.

From the foregoing it will be seen that the present calendar is simple to produce. Both the calendar pages and the metallic plate can be easily worked by conventional material. Both may be printed and provided with decorative, artistic and graphic information. The use of a ring or spiral binding allows for easy assembly and permits used pages to be torn and discarded without destroying or harming the binding. Various modifications, changes, embodiments will be obvious to those skilled in this art. The present is therefore to be taken as illustrative only and not as limiting the invention at all.

What is claimed is:

1. A calendar comprising a plurality of coextensive sheet members, one of said members being a thin ferromagnetic plate of about 0.1 mm thickness, another of said members comprising a stiff non-metallic support and the remainder of said members being a plurality of pages having calendar indicia on only one side thereof, all of said sheet members being rotatably bound together in an integral assembly along one edge thereof by a ring fastener, said sheet members being arranged so that said plate lies between said support and said pages, said pages being arranged so that the calendar indicia lie in chronological sequence from said plate to said support, with the page having the earliest indicia contiguous to said plate, said pages being removable from said ring fastener and rotatable thereabout to present successive pages in chronological sequence contiguous to said plate, and a magnetic indicator movably lying against the earliest page in attraction with the ferromagnetic plate, to highlight a given date thereon.

2. The calendar according to claim 1 wherein said ring fastening means is a spiral ring binder.

3. The calendar according to claim 1 wherein said plate is coated with a non-ferrous material on at least one side.

* * * * *